US007240686B2

(12) United States Patent
Seo

(10) Patent No.: US 7,240,686 B2
(45) Date of Patent: Jul. 10, 2007

(54) COLLAPSIBLE CANOPY HAVING REDUCED LENGTH

(75) Inventor: Dong Woog Seo, Taegu (KR)

(73) Assignee: Caravan Canopy International, Inc., Compton, CA (US)

( * ) Notice: Subject to any disclaimer, the term of this patent is extended or adjusted under 35 U.S.C. 154(b) by 670 days.

(21) Appl. No.: 10/712,224

(22) Filed: Nov. 12, 2003

(65) Prior Publication Data

US 2005/0097829 A1 May 12, 2005

(51) Int. Cl.
*E04H 15/50* (2006.01)

(52) U.S. Cl. ..... 135/131; 135/135; 135/145; 135/159

(58) Field of Classification Search ..... 135/131, 135/145–147, 159, 135
See application file for complete search history.

(56) References Cited

U.S. PATENT DOCUMENTS

| | | | | |
|---|---|---|---|---|
| 1,257,535 | A | 2/1918 | Sampson | |
| 1,712,836 | A | 5/1929 | Mills | |
| 1,772,646 | A | 8/1930 | Strombeck | |
| 2,486,170 | A | 10/1949 | Kavanaugh | |
| 4,156,433 | A | 5/1979 | Beaulieu | |
| 4,607,656 | A | 8/1986 | Carter | |
| 4,779,635 | A | 10/1988 | Lynch | |
| 5,274,980 | A | 1/1994 | Zeigler | |
| 5,275,188 | A | 1/1994 | Tsai | |
| 5,421,356 | A | 6/1995 | Lynch | |
| 5,490,532 | A | 2/1996 | Mallookis et al. | |
| 5,490,533 | A | 2/1996 | Carter | |
| 5,566,701 | A * | 10/1996 | Grey | 135/98 |
| 5,634,483 | A * | 6/1997 | Gwin | 135/131 |
| 5,794,640 | A * | 8/1998 | Jang | 135/131 |
| 5,934,301 | A | 8/1999 | Carter | |
| 5,944,040 | A * | 8/1999 | Jang | 135/126 |
| 6,035,874 | A | 3/2000 | Po-Chang | |
| 6,148,835 | A | 11/2000 | Rhee | |
| 6,230,727 | B1 | 5/2001 | Chen | |
| 6,354,316 | B1 | 3/2002 | Chen | |
| 6,397,872 | B1 | 6/2002 | Carter | |
| 6,439,251 | B2 | 8/2002 | Carter | |
| 6,508,262 | B1 * | 1/2003 | Takayama | 135/145 |
| 6,575,656 | B2 | 6/2003 | Suh | |

(Continued)

FOREIGN PATENT DOCUMENTS

| | | | |
|---|---|---|---|
| GB | 2 404 932 | A * | 2/2005 |

*Primary Examiner*—Robert Canfield
(74) *Attorney, Agent, or Firm*—Christie, Parker & Hale, LLP.

(57) ABSTRACT

A collapsible canopy frame includes a plurality of side poles, and a plurality of scissor assemblies for coupling the side poles to one another. The collapsible canopy frame also includes a center support pole, which includes an outer pole having an upper end and a lower end, and an inner pole slidable within the outer pole. The inner pole has an upper end that can extend upwardly from the outer pole and a lower end that can extend downwardly from the outer pole. A plurality of center scissor assemblies are provided for coupling the plurality of scissor assemblies to the center support pole. A fixing bracket fixed to the lower end of the outer pole has a central opening around the inner pole and a side opening. A locking pin is disposed at least partly in the side opening of the fixing bracket, and is used for fixedly coupling the inner pole to the fixing bracket.

25 Claims, 6 Drawing Sheets

U.S. PATENT DOCUMENTS

| | | | | |
|---|---|---|---|---|
| 6,581,617 | B2 | 6/2003 | Ham et al. | |
| 6,598,614 | B2 * | 7/2003 | Liu | 135/131 |
| 6,708,707 | B2 | 3/2004 | Dotterweich | |
| 2002/0074032 | A1 * | 6/2002 | Park et al. | 135/131 |
| 2003/0024563 | A1 * | 2/2003 | Liu | 135/131 |
| 2003/0172966 | A1 * | 9/2003 | Dotterweich et al. | 135/131 |
| 2004/0182430 | A1 * | 9/2004 | Seo | 135/131 |
| 2004/0255997 | A1 * | 12/2004 | Seo | 135/131 |
| 2005/0028856 | A1 * | 2/2005 | Seo | 135/131 |
| 2005/0241688 | A1 * | 11/2005 | Wu | 135/145 |
| 2006/0070649 | A1 * | 4/2006 | Lee et al. | 135/145 |
| 2006/0096631 | A1 * | 5/2006 | Mallookis et al. | 135/131 |
| 2007/0012347 | A1 * | 1/2007 | Ochi | 135/145 |

* cited by examiner

FIG. 7
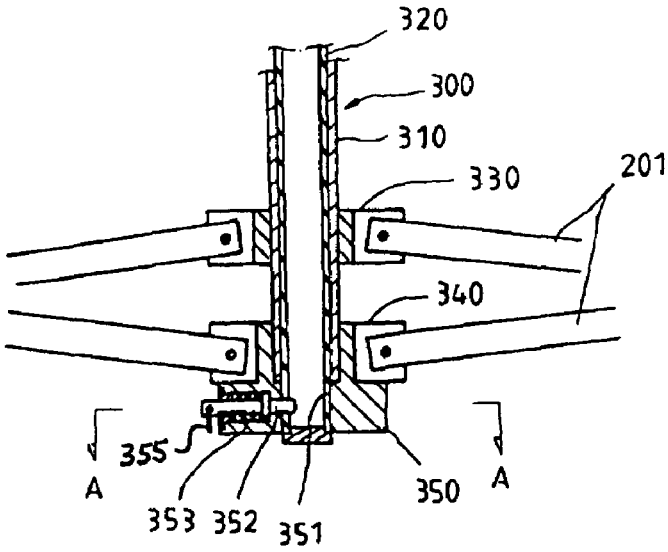
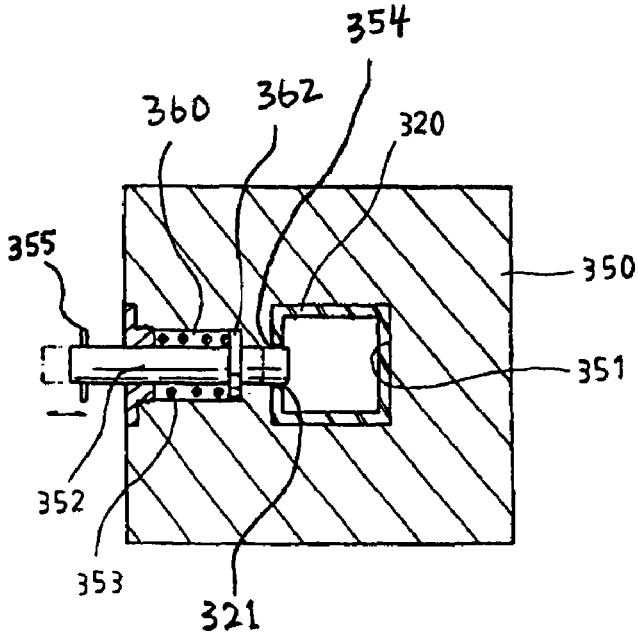
FIG. 8

COLLAPSIBLE CANOPY HAVING REDUCED LENGTH

FIELD OF THE INVENTION

The present invention relates to collapsible canopies, and more particularly to collapsible canopies whose length is reduced upon collapsing.

BACKGROUND

Different designs for collapsible canopies are known. One collapsible canopy has a frame that includes side poles, a center support pole and scissor assemblies, where each scissor assembly is made of a pair of ribs (i.e., truss bars) rotatably coupled in a scissor-like configuration. When the canopy is opened up (i.e., unfolded or erected), the area covered by the canopy is determined by the length and number of the scissor assemblies.

Since the size of the canopy frame (or structure) is directly proportional to the length of the scissor assemblies, the size of the canopy increases as the length of the scissor assemblies increases. Further, with the same length scissor assemblies, as the number of scissor assemblies between the side poles increases, the size of the canopy frame increases.

A problem with the canopy is that the length of the canopy frame, in a collapsed state, is too large to fit into a trunk of a typical passenger vehicle. However, it is desirable to be able to fit a canopy having a conventional size (e.g., 10 feet by 10 feet) in a trunk of a typical passenger vehicle.

SUMMARY

An exemplary embodiment according to the present invention is a collapsible canopy frame, which includes a plurality of side poles, and a plurality of scissor assemblies for coupling the side poles to one another. A center support pole includes an outer pole having an upper end and a lower end, and an inner pole slidable within the outer pole. The inner pole has an upper end that can extend upwardly from the outer pole and a lower end that can extend downwardly from the outer pole. A plurality of center scissor assemblies are provided for coupling the plurality of scissor assemblies to the center support pole. A fixing bracket fixed to the lower end of the outer pole has a central opening around the inner pole and a side opening. A locking pin is disposed at least partly in the side opening of the fixing bracket, and is used for fixedly coupling the inner pole to the fixing bracket.

Another exemplary embodiment according to the present invention is a collapsible canopy frame, which includes a plurality of side poles and a center support pole. The center support pole has an upper end and a lower end, and a head member for supporting a center of a canopy cover is attached at the upper end. A plurality of scissor assemblies are provided for coupling the side poles to one another and to the center support pole. Each scissor assembly includes two ribs that are rotatably coupled to each other. Each rib has an upper end and a lower end and is oriented in a generally vertical direction when the canopy frame is in a collapsed state. The lower end of each rib moves upward by a first distance as the collapsed canopy frame in the collapsed state is opened to an open state, such that the rib becomes oriented in a generally horizontal direction. The head member of the collapsible canopy moves upward between the collapsed state and the open state by a second distance that is greater than the first distance.

These and other aspects of the invention will be more readily comprehended in view of the discussion herein and accompanying drawings, in which like reference numerals designate like elements.

BRIEF DESCRIPTION OF THE DRAWINGS

FIG. 7 is a cross-sectional view that illustrates coupling between a fixing bracket/lower central hub and an inner pole of the collapsible canopy frame of FIG. 1; and FIG. 8 is a cross-sectional view of FIG. 7 along the line A—A.

DETAILED DESCRIPTION

In one exemplary embodiment according to the present invention, the length of the scissor assemblies in a collapsible canopy frame is reduced as compared to a conventional canopy frame, while the number of scissor assemblies are increased, such that the length of the canopy frame in a collapsed state is reduced, while keeping the size of the canopy frame in the open state to be substantially the same as the conventional canopy frame having less number of longer scissor assemblies.

Further, a structure is provided in the collapsible canopy frame of the exemplary embodiment to maintain the distance between the top of the center support pole to the ground to be substantially the same as that of conventional canopies having longer scissor assemblies. This way, the collapsible canopy frame of the exemplary embodiment can fit in a trunk of a typical passenger vehicle, while the top of the center support pole moves upward by a sufficient distance such that the desired roof slope of the canopy can be achieved and a conventional canopy cover can be used.

In the exemplary embodiment, there is provided a canopy frame for a canopy of certain size, which may be substantially the same as the standard or conventional canopy size. The number of scissor assemblies can be increased by a factor of two over that of conventional canopy frames, while the length of each scissor assembly can be decreased by one half.

In addition to reducing the length of the scissor assemblies, the length of the side poles are also reduced in the exemplary embodiment. This is achieved by using telescoping sections in the side poles. For example, in the exemplary embodiment, three sections form each side pole. The number of telescoping sections may be different in other embodiments. Locking mechanisms are used to fix the sections of the telescoping side pole in an extended position. The locking mechanisms may be configured similar to a pull pin assembly illustrated in FIG. 2 or a locking pin assembly illustrated in FIGS. 7 and 8.

Further, the center support pole is telescoping with two sections where one of the sections is extendable to compensate for the reduction in the upward movement of the center support pole resulting from using shorter scissor assemblies. In the center support pole, an inner pole is lifted (i.e., telescoped) upward to maintain the shape and function of the roof of the canopy.

Different numbers of shorter scissor assemblies may be used. Further, the length of each shorter scissor assemblies may be different from one half of the conventional scissor assemblies. Similarly, the number of sections in each of the telescoping side pole and the center support pole may be different from three and two, respectively. In addition, the number and/or length of the side poles may be different in other embodiments.

Figure 1:
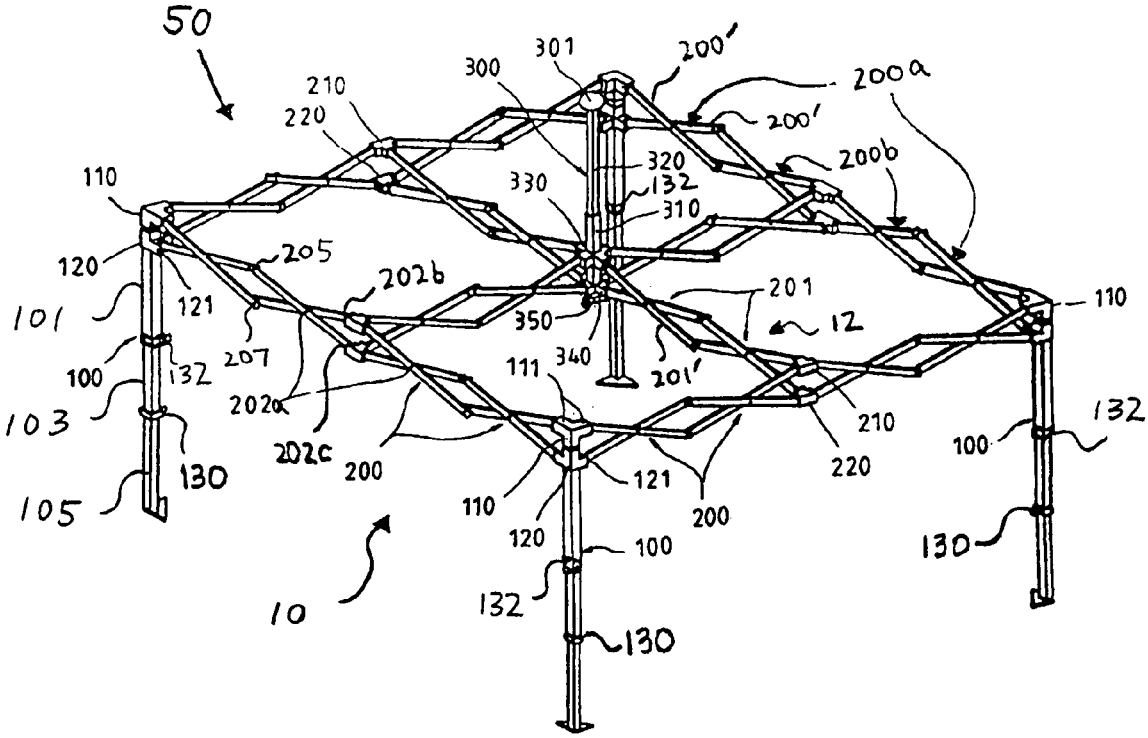
FIG. 1 is a perspective view of a collapsible canopy frame in an exemplary embodiment according to the present invention in a fully erected state.

FIG. 1 illustrates a canopy frame 50 in an exemplary embodiment according to the present invention. The canopy frame 50 includes four telescoping side poles 100 and edge scissor assemblies 200 that interconnect each pair of adjacent side poles 100. The side poles 100 are structured such that each side pole is located at one of the four corners of a square. Each pair of adjacent side poles 100 are interconnected to each other through four edge scissor assemblies 200. The edge scissor assemblies include inner edge scissor assemblies 200*b* and outer edge scissor assemblies 200*a* depending on their location with respect to other edge scissor assemblies, and may also be referred to simply as inner and outer scissor assemblies, respectively.

Figure 2:
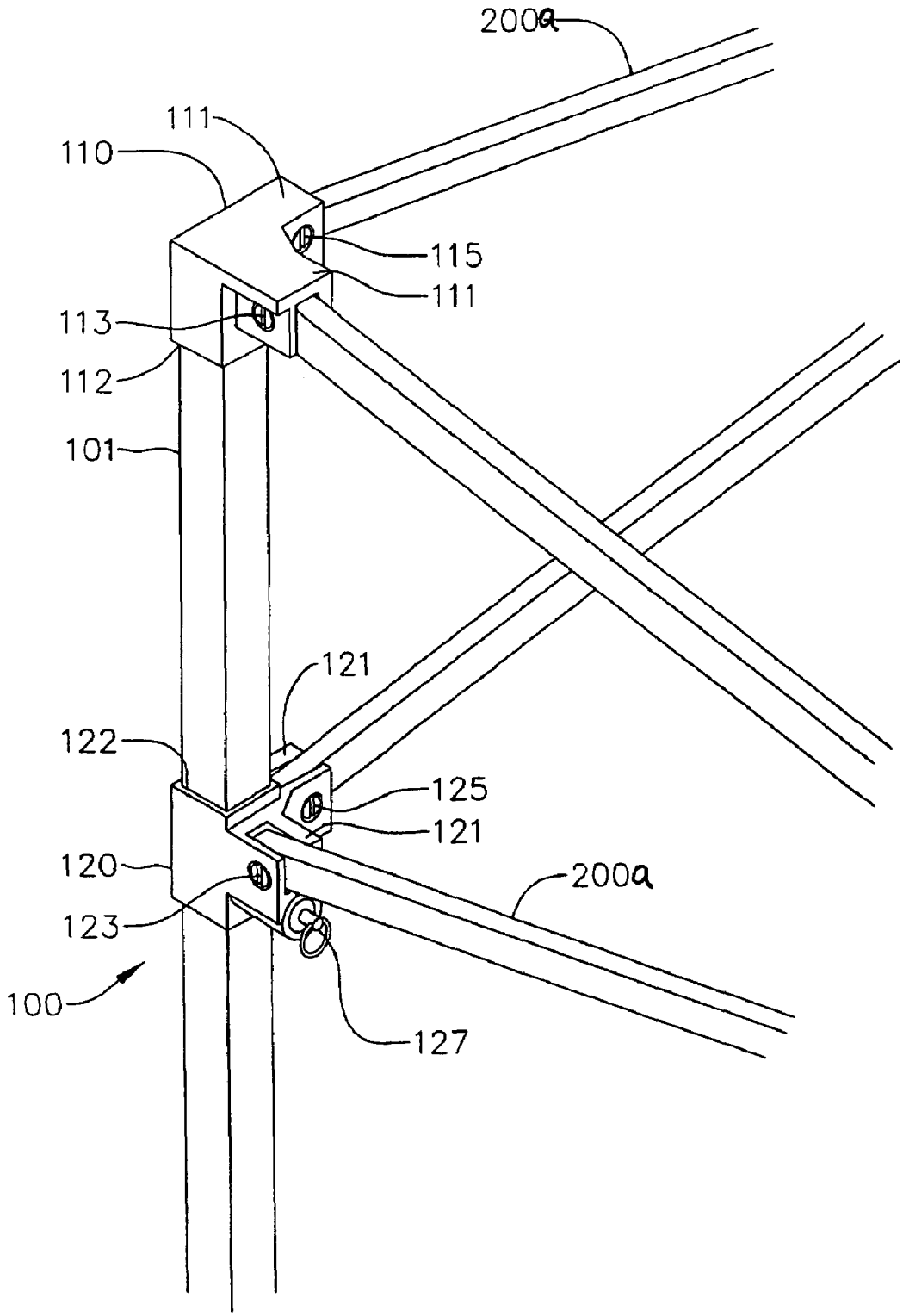
FIG. 2 illustrates a stationary mounting bracket and a sliding mounting bracket mounted on a side pole of the collapsible canopy frame of FIG. 1.

Referring to FIGS. 1 and 2, each side pole 100 has a substantially square cross-section. In other embodiments, the side poles may have rectangular or other cross sectional shapes. Each telescoping side pole includes three telescoping sections 101, 103 and 105, which correspond to upper, middle and lower sections, respectively. Each telescoping section has a substantially square cross-section, where the cross-section of the middle section 103 is smaller than the cross-section of the upper section 101, and the cross-section of the lower section 105 is smaller than the cross-section of the middle-section 103. The lower section 105 is slid into the middle section 103, which in turn, is slid into the upper section 101.

Each telescoping side pole 100 also has mounted thereon locking pin mechanisms 130 and 132. The locking pin mechanism 132 is used to fix the middle section 103 to the upper section 101. Further, the locking pin mechanism 130 is used to fix the middle section 103 to the lower section 105. The locking pin mechanism locks the sections 101, 103 and 105 of the telescoping side pole in various extended positions. Each of the locking mechanisms 130 and 132, for example, is the pull pin assembly 127 of FIG. 2. As an alternative, it may be the locking mechanism illustrated in FIGS. 7 and 8, which uses a locking pin 352. The locking mechanisms 130 and 132 may also be other suitable locking pin assemblies, a pull pin assembly and/or other locking mechanisms that would be obvious to those skilled in the art from the teachings herein.

Referring now to FIGS. 1 and 2, each side pole 100 has mounted thereon at the top a stationary mounting bracket 110 that has two connecting members 111 that face at substantially a right angle to each other. The stationary mounting bracket 100 also has formed thereon a socket 112 at right angle to connecting members 111 for mounting the stationary mounting bracket 110 on top of the respective side pole 100. The socket 112 has a square cross sectional shape such that the socket will stably receive and engage the top square end of the side pole 100.

Each side pole 100 also has slidably mounted thereon below the stationary mounting bracket 110 a sliding mounting bracket 120 that has two connecting members 121 facing at substantially a right angle to each other. The connecting members 121 are facing in substantially the same direction as the connecting members 111. The sliding mounting bracket 120 has an opening 122 therethrough for slidably coupling with the upper section 101. The opening 122 has a substantially square cross sectional shape to receive in close but slidably fitting relation, the upper section 101, which has a substantially square cross sectional shape.

A set 10 of edge scissor assemblies 200 are connected between each pair of adjacent side poles 100, and include two outer edge scissor assemblies 200*a* that are pivotably coupled to the respective side poles 100 and two inner edge scissor assemblies 200*b* that are pivotably coupled to each other and also to the respective outer edge scissor assemblies.

The upper and lower outer ends of each of the outer edge scissor assemblies 200*a* are connected to connecting member of stationary bracket 110 and a connecting member of sliding bracket 120, respectively, using pins such that they are rotatably (i.e., pivotably) coupled to the respective side poles 100. As shown in FIG. 2, the upper outer ends of the outer edge scissor assemblies 200*a* are pivotably coupled to the respective stationary connecting members 111 using pins 113 and 115. Each of the pins 113 and 115 may be a screw, a bolt and nut combination, and/or any other pin having an axis about which the respective rib of the scissor assembly 200 can pivot. Similarly, the lower outer ends of the outer edge scissor assemblies are pivotably coupled to the respective connecting members 121 using pins 123 and 125. The pins 123 and 125 may be similar to the pins 113 and 115, respectively.

Each of the scissor assemblies 200 are formed of a pair of ribs 200' connected together and rotatable about pivot 202*a*. Each of the connecting members connected to its scissor assembly has substantially parallel side walls which closely fit next to and support substantially parallel side walls of the rectangular ribs 200' as they rotate. In other embodiments, the side walls of the connecting members may not be parallel. Instead, a protrusion or another supporting structure may be formed on the inner surface of one or both side walls of each connecting member to support the parallel side walls of the rectangular ribs 200'.

Upper and lower inner ends of the outer edge scissor assemblies 200*a* are coupled to upper and lower outer ends of the inner edge scissor assemblies 200*b* using pins 205 and 207, respectively, so that they are pivotable relative to each other. As the angle between the scissor assemblies and the connecting members 111 and 121 increases as the canopy frame is opened, the distance between adjacent side poles 100 is increased. At the same time, the sliding mounting brackets 120 slide along the upper section 101 in an upward direction towards the respective stationary mounting brackets 110. Pull pin assembly 127, in each sliding mounting bracket 120, includes a pull pin, which is biased to normally engage an aperture in the upper section 101 and lock the sliding bracket 120 to the upper section 101. Upon disengaging the pull pin (e.g., by pulling it from the aperture), the sliding mounting bracket 120 can be moved upward or downward with respect to the upper section 101. In other embodiments, the sliding mounting bracket 120 may slide on other sections of the respective telescoping side pole 100.

Further, the sliding mounting bracket may be locked to the telescoping side pole 100 using other locking mechanisms.

Figure 3:
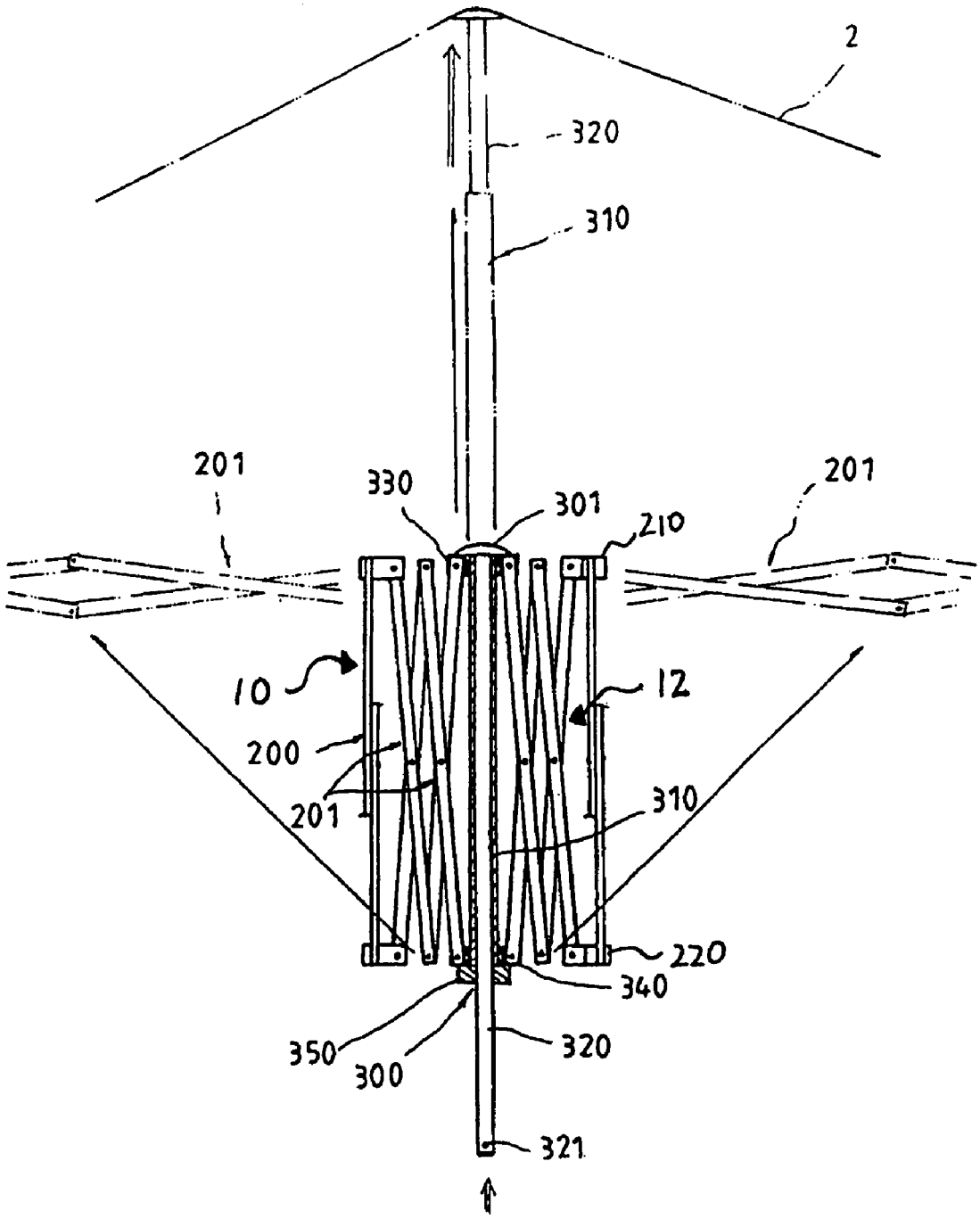
FIG. 3 illustrates an opening operation of the collapsible canopy frame of FIG. 1.

Ribs of the two inner edge scissor assemblies of each set 10 of edge scissor assemblies are pivotably coupled to each other via an upper connecting bracket 210 and a lower connecting bracket 220. As depicted in FIGS. 1 and 3, the upper end 202*b* (i.e., upwardly extending pivoted end) of one of the two ribs in each inner edge scissor assembly is pivotably coupled to the upper connecting bracket 210 while the lower end 202*c* (i.e., downwardly extending pivoted end) of the other one of the two ribs in each inner edge scissor assembly is pivotably coupled to the lower connecting bracket 220.

Referring now to FIGS. 1 and 3, a different set 12 of center scissor assemblies 201 is connected between center support pole 300 and each set 10 of edge scissor assemblies. Each of the center scissor assemblies 201 has two ribs 201' and are essentially the same as the scissor assemblies of the edge set of scissor assemblies. Each set 12 of center scissor assemblies has two scissor assemblies 201 which interconnect the center support pole 300 to the mid-point of the corresponding set of edge scissor assemblies.

FIG. 3 illustrates a closed position of the canopy frame, where the ribs 201' that form the center scissor assembly 201 are in a generally vertical orientation. Upon opening the canopy frame, the ribs of the center scissor assembly 201 rotate relative to one another such that the ribs become oriented in a generally horizontal direction as depicted in phantom in FIG. 3.

In other embodiments, different number and/or size of center scissor assemblies in each set may be used. When the number and/or size of the center scissor assemblies are increased or decreased, as those skilled in the art would appreciate, the number and/or size of the edge scissor assemblies should be adjusted correspondingly. For example, when the number of center scissor assemblies are doubled to four in each set, the number of the edge scissor assemblies between two adjacent side poles are doubled to eight. In such configuration, an upper central hub 330 is connected to the upper connecting bracket 210 through the respective ribs of the center scissor assemblies, while the lower central hub 340 is connected to the lower connecting bracket 220 through the respective ribs of the center scissor assemblies.

Figure 4:
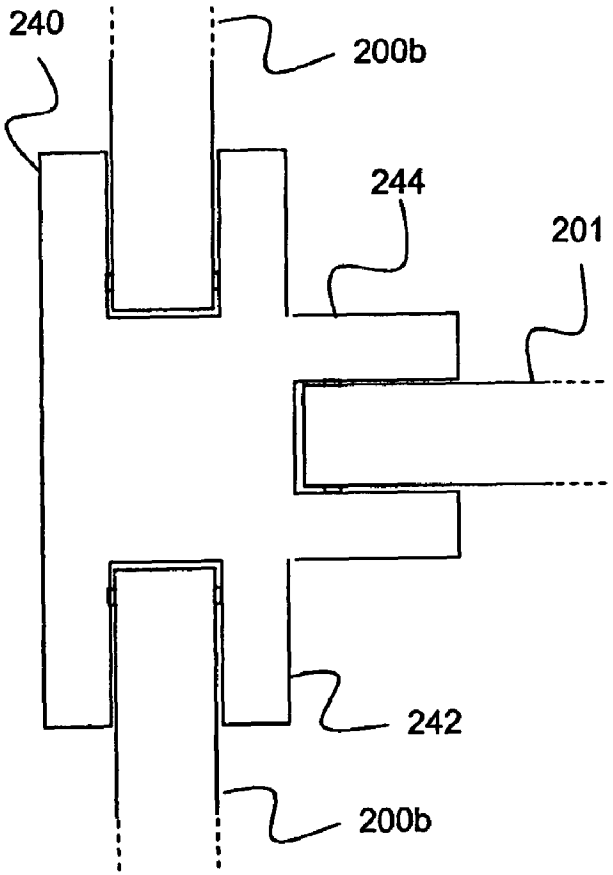
FIG. 4 illustrates a cross sectional view of upper and lower connecting brackets in an exemplary embodiment according to the present invention.
Figure 6:
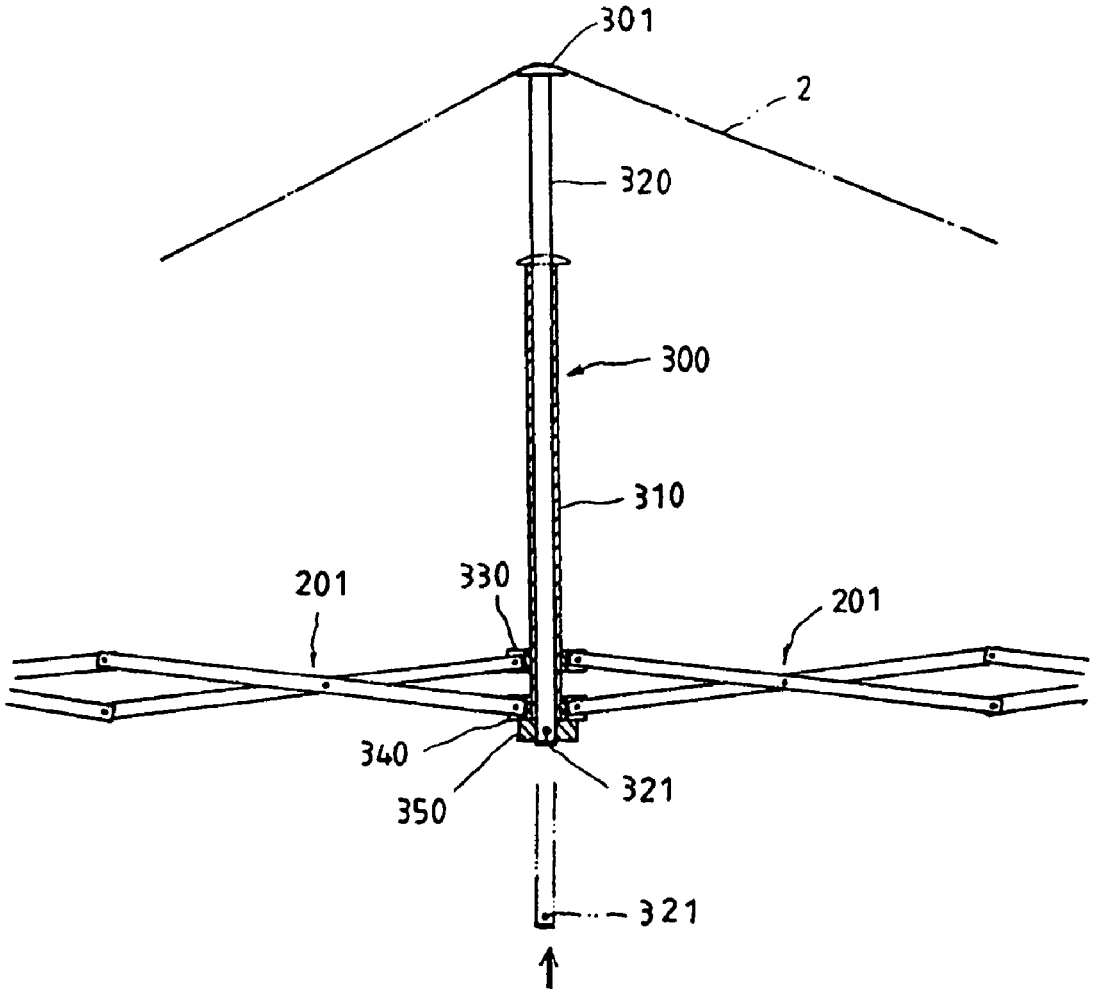
FIG. 6 illustrates an upward movement of the center support pole of the collapsible canopy frame of FIG. 1.

Each upper connecting bracket 210 and the lower connecting bracket 220 has three connecting members 240, 242 and 244 (shown in FIG. 4), two (240, 242) of which face at substantially 180 degrees of each other, and the third (244) of which faces at substantially a right angle with respect to each of the two 180-degree apart connecting members. The connecting bracket illustrated in FIG. 4 represents a cross sectional view of both the upper connecting bracket 210 and the lower connecting bracket 220. The connecting brackets may have other suitable cross sectional shapes in other embodiments.

The connecting members of the upper and lower connecting brackets 210 and 220 pivotably couple with ribs of the respective set of edge scissor assemblies. The 180-degree apart connecting members 240, 242 couple the two inner edge scissor assemblies 200*b* to each other, while the third connecting member 244 is pivotably coupled to upper and lower central hubs 330 and 340, respectively, on the center support pole 300 via the respective set 12 of center scissor assemblies 201.

Figure 5:
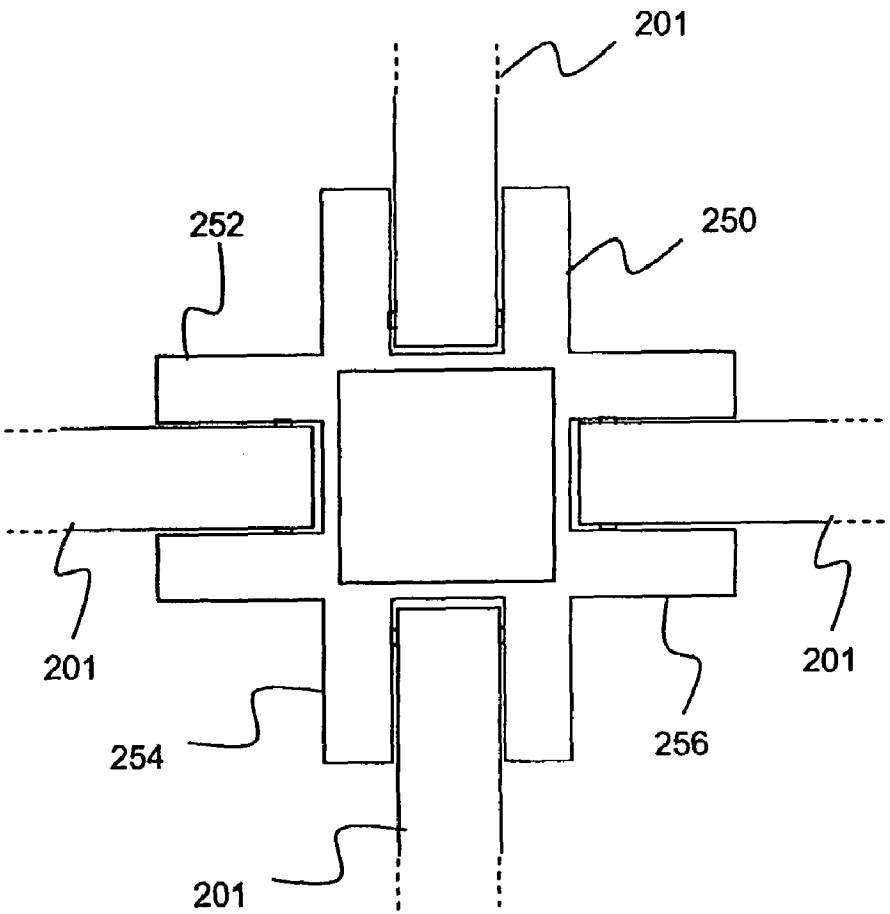
FIG. 5 illustrates a cross sectional view of upper and lower central hubs in an exemplary embodiment according to the present invention.

FIG. 5 illustrates a central hub, which represents a cross sectional view of both the upper central hub 330 and the lower central hub 340. The central hubs may have other suitable cross sectional shapes in other embodiments. The upper and lower central hubs 330 and 340 each have four connecting members 250, 252, 254, 256, each facing one set of edge scissor assemblies. The upper and lower central hubs are connected to four different center scissor assemblies that extend at approximately 90-degrees apart from one other.

In more detail, two interconnected center scissor assemblies 201 are coupled between the upper and lower connecting brackets 210, 220 and upper and lower central hubs 330 and 340. At the inner end of the ribs 201' of the center scissor assemblies 201, the upper end of a rib is pivotably coupled to the respective connecting member of the upper central hub 330. Further, the lower end of a rib is pivotably coupled to the respective connecting member of the lower central hub 340. The center scissor assemblies are pivotably coupled with respect to one another, and also with respect to the center support pole.

Returning now to FIG. 3, the center support pole 300 includes an outer pole 310 and an inner pole 320 that slide inside of the outer pole 310, and telescope relative to each other. At the top of the center support pole 300 is a convex shaped head member 301, which supports a canopy cover 2 at the center of the canopy frame. At the bottom of the center support pole 300 is a fixing bracket 350, to which the inner pole 320 can be fixed.

By placing four edge scissor assemblies between each pair of adjacent side poles, the four side poles can be opened up in a diagonal direction with respect to the axis of the center support pole 300. This way, the substantially square shape of the canopy frame is realized.

FIG. 3 illustrates, in phantom lines, an opening operation of the collapsible canopy frame of FIG. 1, during which the inner pole 320 is telescopically extended up from the outer pole 310. Also, the center support pole 300 has mounted thereon the upper central hub 330 and the lower central hub 340. The upper central hub 330 is slidable with respect to the outer pole 310 while the lower central hub 340 is substantially stationary with respect to the outer pole 310.

The fixing bracket 350 is mounted below the stationary lower central hub 340. The fixing bracket 350 is fixed to the outer pole 310 and/or the lower central hub 340, and may be formed as a single integrated piece with the lower central hub 340. As can be seen in FIG. 3, in the collapsed state, the inner pole 320 slides down from the outer pole 310. The inner pole 320 has near its lower end a locking opening 321 that can be used to fix the inner pole to the fixing bracket 350.

As can be seen in FIGS. 3 and 6–8, the fixing bracket 350 has a square opening 351 (i.e., a central opening) through its center for allowing the square outer perimeter of the inner pole 320 to move upward (and downward) through the square inner passage of the outer pole 310. The opening 351 is substantially square in shape in the exemplary embodiment to engage the inner pole 320 that has a substantially square cross section. In other embodiments, the cross section of the outer/inner pole and/or the shape of the openings may be rectangular or other shape.

The fixing bracket 350 also has an opening 360 on its side for inserting a locking pin assembly, which includes a biasing member 353 (e.g., spring) and a locking pin 352. The locking pin 352 has formed thereon a flange member 362 for engaging the biasing member 353 such that the locking pin is biased towards an inner opening 354 of the fixing bracket 350. Further, the flange 362 is larger than the inner opening 354 such that the locking pin 352 does not enter the central opening 351 more than a predetermined portion (e.g., a tip). The locking pin 352 is coupled to a ring 355, which may be used to pull the locking pin 352 to disengage the tip of the pin from the inner opening 354.

As can be seen in FIG. 8, when the locking opening 321 of the inner pole 320 is aligned with the inner opening 354 of the fixing bracket 350, the tip of the locking pin 352 is inserted through both the openings 321 and 354. Since the locking pin 352 is biased by the biasing member 353 towards the central opening 351, the tip of the locking pin 352 automatically enters through the locking opening 321 when the openings are aligned, thereby fixing the inner pole to the fixing bracket 350. When the locking opening 321 is not aligned with the inner opening 354, the tip of the pin 352 is stopped by the surface of the inner pole 320 from entering into the central opening 351.

To open the canopy frame 50 from its closed (i.e., collapsed) state, first the telescoping side poles are extended to a desired length. The side poles 100 are then pulled in diagonal directions away from each other, and the distance between the side poles 100 are increased, as is the distance between the center support pole 300 and the side poles 100.

During the opening, the scissor assemblies open up to be oriented in a generally horizontal direction, and the sliding mounting brackets 120 and the lower central hub 340 also move upward. Therefore, the center support pole 300 which is fixed to the lower central hub 340 is also moved upward.

In the exemplary embodiment, the inner pole 320 of the center support pole 300 is moved upward with respect to the outer pole 310 before expanding the canopy frame by moving the side poles away from each other. Because of the locking opening 321 on the inner pole 320 and the biasing member 353 that biases the locking pin 352 toward the inner pole 320, when the inner pole is moved upward by a predetermined distance, the tip of the locking pin 352 enters the inner opening 354 and the locking opening 321, thereby engaging the locking pin to the inner opening 354 and the locking opening 321, and the inner pole 320 is fixed to the fixing bracket 350 in an extended state. In other embodiments, the inner pole 320 may be moved upward with respect to the outer pole 310 either before, during or after expanding the canopy frame by moving the side poles away from each other.

After extending the inner pole 320, as the support poles are moved away from each other to a furthest distance possible and the scissor assemblies 200, 201 fully open up, the lower central hub 340 moves upward, and the outer pole 310 mounted on the lower central hub moves through the upper central hub 330. Therefore, the inner pole 320 is also moved upward together with the outer pole 310.

While the rising of the outer pole by itself may not be sufficient, since the inner pole 320 has already been extended, sufficient height is provided to the center support pole 300 such that the head member 301 is positioned to support the center top of the canopy cover 2. The height can be predetermined to correspond to the maximum height of the center support pole in conventional canopy frames. Hence, the canopy frame of the exemplary embodiment can be used as a frame for conventional canopy covers.

To collapse the canopy in its open state, opposing steps may be taken in a reverse order. First, the side poles 100 are gathered at the center together with the center support pole 300. The scissor assemblies 200 and 201 are closed such that the ribs that form the scissor assemblies are oriented in a generally vertical direction. Prior to completing gathering of the side poles 100 at the center, by pulling the locking pin 352, the tip of the locking pin is disengaged from the locking opening 321, and the inner pole may be moved downward. In other embodiments, the locking pin may be disengaged either before, during or after bringing all the side poles to the center.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

For example, while the exemplary embodiment described herein has four side poles, other embodiments may have different number of side poles such as six or eight. Further, the canopy frame may have other shapes such as triangular, hexagonal or the like.

What is claimed is:

1. A collapsible canopy frame comprising:

a plurality of side poles;

a plurality of scissor assemblies for coupling the side poles to one another;

a center support pole comprising:

an outer pole having an upper end and a lower end;

an inner pole slidable within the outer pole, said inner pole having an upper end that can extend upwardly from the outer pole and a lower end that can extend downwardly from the outer pole;

a plurality of center scissor assemblies for coupling the plurality of scissor assemblies to the center support pole;

a fixing bracket fixed to the lower end of the outer pole, the fixing bracket comprising a central opening around the inner pole and a side opening; and a locking pin disposed at least partly in the side opening of the fixing bracket, said locking pin for fixedly coupling the inner pole to the fixing bracket.

2. The collapsible canopy frame of claim 1, wherein the inner pole has a locking opening formed thereon near the lower end for engagement with the locking pin.

3. The collapsible canopy frame of claim 2, further comprising:

a biasing member that engages the locking pin and biases it towards the central opening, wherein the locking pin engages the locking opening when the upper end of the inner pole extends upwardly from the outer pole and the locking opening is aligned with the locking pin.

4. The collapsible canopy frame of claim 1, wherein each of said scissor assemblies comprises a pair of ribs that are rotatably coupled to each other about a middle of each of said pair of ribs.

5. The collapsible canopy frame of claim 1, wherein there are four interconnected scissor assemblies between each pair of adjacent said side poles, which comprise two inner edge scissor assemblies and two outer edge scissor assemblies, wherein the two inner edge scissor assemblies are pivotably coupled to each other, and the two outer edge scissor assemblies are pivotably coupled to the respective said inner edge scissor assemblies and the respective said side poles.

6. The collapsible canopy frame of claim 5, further comprising a plurality of upper connecting brackets and a plurality of lower connecting brackets, wherein the two inner edge scissor assemblies are pivotably coupled to each other via respective upper and lower connecting brackets.

7. The collapsible canopy frame of claim 6, wherein two said center scissor assemblies are pivotably coupled between the upper and lower connecting brackets and the center support pole.

8. The collapsible canopy frame of claim 7, further comprising an upper central hub slidably mounted on the outer pole and a lower central hub fixedly mounted at the lower end of the outer pole, each of the upper and lower central hubs comprising a plurality of connecting members in a general direction of the respective connecting brackets, wherein the inner scissor assemblies are pivotably coupled between respective said connecting members of the upper and lower central hubs and respective said upper and lower connecting brackets.

9. The collapsible canopy frame of claim 8, wherein the lower central hub is fixedly coupled to the fixing bracket.

10. The collapsible canopy frame of claim 1, wherein each said side pole is a telescoping side pole comprising a plurality of side pole sections.

11. The collapsible canopy frame of claim 10, wherein each said side pole comprises at least one other locking pin for locking at least two said side pole sections in an extended position.

12. The collapsible canopy frame of claim 10, wherein each said side pole comprises three telescoping side pole sections that can be locked in an extended position.

13. The collapsible canopy frame of claim 1, wherein the collapsible canopy frame in a collapsed state has the lower end of the inner pole extending downwardly from the outer pole.

14. The collapsible canopy frame of claim 1, wherein the collapsible canopy frame in an open state has the upper end of the inner pole extending upwardly from the outer pole.

15. The collapsible canopy frame of claim 1, wherein the biasing member comprises a spring.

16. The collapsible canopy frame of claim 1, further comprising a head member mounted on the upper end of the inner pole, wherein the head member is used to support a canopy cover at a center.

17. A collapsible canopy frame comprising:

a plurality of telescoping side poles;

a plurality of scissor assemblies for coupling the side poles to one another, each scissor assembly comprising a pair of ribs that are rotatably coupled to each other;

a center support pole comprising:

an outer pole having an upper end and a lower end;

an inner pole slidable within the outer pole, said inner pole having an upper end that is extendable upwardly from the outer pole and a lower end that is extendable downwardly from the outer pole, and having a locking opening formed thereon near the lower end;

a plurality of center scissor assemblies for coupling the plurality of scissor assemblies to the center support pole;

a fixing bracket fixed to the lower end of the outer pole, the fixing bracket comprising a central opening around the inner pole and a side opening; and a locking pin assembly disposed at least partly in the side opening of the fixing bracket, comprising:

a locking pin; and a biasing member that engages the locking pin and biases it towards the central opening, wherein the locking pin engages the locking opening when the upper end of the inner pole extends upwardly from the outer pole and the locking opening is aligned with the locking pin.

18. The collapsible canopy frame of claim 17, wherein there are four interconnected scissor assemblies between each pair of adjacent said side poles, which comprise two inner edge scissor assemblies and two outer edge scissor assemblies, wherein the two inner edge scissor assemblies are pivotably coupled to each other, and the two outer edge scissor assemblies are pivotably coupled to the respective said inner edge scissor assemblies and the respective said side poles.

19. The collapsible canopy frame of claim 18, further comprising a plurality of upper connecting brackets and a plurality of lower connecting brackets, wherein the two inner edge scissor assemblies are pivotably coupled to each other via respective upper and lower connecting brackets.

20. The collapsible canopy frame of claim 19, wherein two said inner scissor assemblies are pivotably coupled between the upper and lower connecting brackets and the center support pole.

21. The collapsible canopy frame of claim 20, further comprising an upper central hub slidably mounted on the outer pole and a lower central hub fixedly mounted at the lower end of the outer pole, each of the upper and lower central hubs comprising a plurality of connecting members facing a general direction of the respective connecting brackets, wherein the center scissor assemblies are pivotably coupled between respective said connecting members of the upper and lower central hubs and respective said upper and lower connecting brackets.

22. The collapsible canopy frame of claim 21, wherein the lower central hub is fixedly coupled to the fixing bracket.

23. A collapsible canopy frame comprising:

a plurality of side poles;

a center support pole having an upper end and a lower end, wherein a head member for supporting a center of a canopy cover is attached at the upper end; and a plurality of scissor assemblies for coupling the side poles to one another and to the center support pole, each scissor assembly comprising two ribs that are rotatably coupled to each other, each rib having an upper end and a lower end and being oriented in a generally vertical direction when the canopy frame is in a collapsed state, wherein the lower end of each rib moves upward by a first distance as the collapsed canopy frame in the collapsed state is opened to an open state, such that the rib becomes oriented in a generally horizontal direction, wherein the head member of the collapsible canopy moves upward between the collapsed state and the open state by a second distance that is greater than the first distance, and wherein the center support pole comprises:

an outer pole;

an inner pole slidable within the outer pole, said inner pole having an upper end that can extend upwardly from the outer pole and a lower end that can extend downwardly from the outer pole, wherein the head member is attached at the upper end of the inner pole, wherein the outer pole moves upward between the collapsed state and the open state, and the inner pole moves upward with respect to the outer pole between the collapsed state and the open state, such that the center support pole is in an extended state.

24. The collapsible canopy frame of claim 23, further comprising a locking pin for fixedly coupling the inner pole to the outer pole when the center support pole is in the extended state.

25. A collapsible canopy comprising:

a plurality of telescoping side poles;

a set of edge scissor assemblies between each of pairs of the side poles, each scissor assembly of said edge scissor assemblies having relatively rotatable ribs;

each said set of edge scissor assemblies comprising outer scissor assemblies and inner scissor assemblies, a different first said rib of each of the outer scissor assemblies being pivotably affixed at an upper end of a different one of the side poles, the first ribs being pivotably coupled together through upwardly extending pivoted ends of the ribs of the inner scissor assemblies, a different second said rib of each of the outer scissor assemblies being pivotably connected to a bracket which is slidable along a different one of the side poles, the second ribs being pivotably coupled through downwardly extending pivoted ends of the ribs of the inner scissor assemblies;

telescoping center pole assembly having an outer pole and an inner pole;

a set of center scissor assemblies for each said set of edge scissor assemblies, each said set of center scissor assemblies having relatively rotatable ribs;

each said set of center scissor assemblies comprising a third rib which is pivotably connected to a bracket which is slidable along the center pole assembly and a fourth rib which is pivotably coupled to the third rib and is pivotably coupled to the upwardly extending pivoted ends of the ribs in the corresponding set of edge scissor assemblies, and a fifth rib which is pivotably connected to a lower end of the outer pole and a sixth rib which is pivotably coupled to the fifth rib and is pivotably coupled to the downwardly extending pivoted ends of the ribs in the corresponding set of edge scissor assemblies.

* * * * *